US009307331B2

(12) United States Patent
Pedersen

(10) Patent No.: US 9,307,331 B2
(45) Date of Patent: Apr. 5, 2016

(54) HEARING DEVICE WITH SELECTABLE PERCEIVED SPATIAL POSITIONING OF SOUND SOURCES

(71) Applicant: GN ReSound A/S, Ballerup (DK)

(72) Inventor: Brian Dam Pedersen, Ringsted (DK)

(73) Assignee: GN ReSound A/S, Ballerup (DK)

( * ) Notice: Subject to any disclaimer, the term of this patent is extended or adjusted under 35 U.S.C. 154(b) by 38 days.

(21) Appl. No.: 14/138,021

(22) Filed: Dec. 21, 2013

(65) Prior Publication Data

US 2015/0181355 A1 Jun. 25, 2015

(30) Foreign Application Priority Data

Dec. 19, 2013 (DK) ..... 2013 70793
Dec. 19, 2013 (EP) ..... 13198545

(51) Int. Cl.
*H04R 25/00* (2006.01)

(52) U.S. Cl.
CPC ..... *H04R 25/407* (2013.01); *H04R 25/40* (2013.01); *H04R 25/55* (2013.01); *H04R 25/552* (2013.01)

(58) Field of Classification Search
CPC .... H04R 25/40; H04R 25/402; H04R 25/405; H04R 25/407; H04R 25/552; H04R 2460/01; H04R 2225/43; H04M 3/568
See application file for complete search history.

(56) References Cited

U.S. PATENT DOCUMENTS

| | | | | |
|---|---|---|---|---|
| 6,850,496 | B1 | 2/2005 | Knappe et al. | |
| 2002/0151996 | A1 | 10/2002 | Wilcock et al. | |
| 2005/0265535 | A1 | 12/2005 | Kanada | |
| 2006/0018497 | A1 | 1/2006 | Kornagel | |
| 2008/0187143 | A1 | 8/2008 | Mak-Fan | |
| 2009/0112589 | A1 | 4/2009 | Hiselius et al. | |
| 2010/0273505 | A1 | 10/2010 | Moller et al. | |
| 2010/0328419 | A1 | 12/2010 | Etter | |
| 2011/0060435 | A1 | 3/2011 | Lee et al. | |
| 2011/0069643 | A1 | 3/2011 | Yoakum et al. | |
| 2013/0041648 | A1 | 2/2013 | Osman | |
| 2015/0036856 | A1* | 2/2015 | Pruthi ..... | G06F 3/04842 381/317 |

OTHER PUBLICATIONS

First Danish Office Action and Search Report dated Mar. 14, 2014 for related DK Patent Application No. PA 2013 70793, 6 pages.
Extended European Search Report dated May 16, 2014 for related EP Patent Application No. 13198545.9, 11 pages.
Renato Pellegrini et al., "Wave Field Synthesis: Mixing and Mastering Tools for Digital Audio Workstations", Audio Enginering Society 116th Convention, Convention Paper 6117, May 8, 2004.
Second technical examination dated Oct. 16, 2014, for corresponding Danish Patent Application No. PA 2013 70793, 2 pages.
Third technical examination dated Apr. 17, 2015, for corresponding Danish Patent Application No. PA 2013 70793, 2 pages.
Fourth technical examination—Intention to Grant dated May 18, 2015, for corresponding Danish Patent Application No. PA 2013 70793, 2 pages.

* cited by examiner

*Primary Examiner* — Matthew Eason
(74) *Attorney, Agent, or Firm* — VIsta IP Law Group, LLP

(57) ABSTRACT

A new hearing device system is disclosed herein. The hearing device system has a hearing device and a control device that allows a user to select perceived directions of arrival of selected sound signals transmitted to the hearing device.

17 Claims, 6 Drawing Sheets

HEARING DEVICE WITH SELECTABLE PERCEIVED SPATIAL POSITIONING OF SOUND SOURCES

RELATED APPLICATION DATA

This application claims priority to and the benefit of Danish Patent Application No. PA 2013 70793, filed on Dec. 19, 2013, and European Patent Application No. 13198545.9, filed on Dec. 19, 2013. The entire disclosures of both of the above applications are expressly incorporated by reference herein.

FIELD AND BACKGROUND

The subject application relates to a hearing device and method of using the same.

SUMMARY

A new hearing device system is disclosed herein. The hearing device system has a hearing device and a control device that allows a user to select perceived directions of arrival of selected sound signals transmitted to the hearing device.

The hearing device may be a headset, a headphone, an earphone, an ear defender, an earmuff, etc, e.g. of the following types: Ear-Hook, In-Ear, On-Ear, Over-the-Ear, Behind-the-Neck, Helmet, Headguard, etc.

The hearing device may be a binaural hearing aid. The hearing aids of the binaural hearing aid may be of the types: BTE, RIE, ITE, ITC, CIC, etc.

The control device may be a computer, such as a PC, such as a stationary PC, a portable PC, etc, or a hand-held device, such as a tablet PC, such as an IPAD, etc, a smartphone, such as an (phone, an Android phone, a windows phone, etc, etc.

Hearing impaired individuals often experience at least two distinct problems:

1) A hearing loss, which is an increase in hearing threshold level, and
2) A loss of ability to understand speech in noise in comparison with normal hearing individuals. For most hearing impaired patients, the performance in speech-in-noise intelligibility tests is worse than for normal hearing people, even when the audibility of the incoming sounds is restored by amplification. Speech reception threshold (SRT) is a performance measure for the loss of ability to understand speech, and is defined as the signal-to-noise ratio required in a presented signal to achieve 50 percent correct word recognition in a hearing in noise test.

In order to compensate for hearing loss, today's digital hearing aids typically use multi-channel and compression signal processing to restore audibility of sound for a hearing impaired individual. In this way, the patient's hearing ability is improved by making previously inaudible speech cues audible.

However, loss of ability to understand speech in noise, including speech in an environment with multiple speakers, remains a significant problem of most hearing aid users.

One tool available to a hearing aid user in order to increase the signal to noise ratio of speech originating from a specific speaker, is to equip the speaker in question with a microphone, often referred to as a spouse microphone, that picks up speech from the speaker in question with a high signal to noise ratio due to its proximity to the speaker. The spouse microphone converts the speech into a corresponding audio signal with a high signal to noise ratio and transmits the signal, preferably wirelessly, to the hearing aid for hearing loss compensation. In this way, a speech signal is provided to the user with a signal to noise ratio well above the SRT of the user in question.

Another way of increasing the signal to noise ratio of speech from a speaker that a hearing aid user desires to listen to, such as a speaker addressing a number of people in a public place, e.g. in a church, an auditorium, a theatre, a cinema, etc., or through a public address systems, such as in a railway station, an airport, a shopping mall, etc., is to use a telecoil to magnetically pick up audio signals generated, e.g., by telephones, FM systems (with neck loops), and induction loop systems (also called "hearing loops"). In this way, sound may be transmitted to hearing aids with a high signal to noise ratio well above the SRT of the hearing aid users.

However, in a situation in which a user of a conventional binaural hearing aid or another type of hearing device desires to listen to more than one of the above-mentioned monaural audio signal sources simultaneously, the user will find it difficult to separate one signal source from another.

U.S. Pat. No. 8,208,642 B2 discloses a method and an apparatus for a binaural hearing aid in which sound from a single monaural signal source is presented to both ears of a user wearing the binaural hearing aid in order to obtain benefits of binaural hearing when listening to the monaural signal source. The sound presented to one ear is phase shifted relative to the sound presented to the other ear, and additionally, the sound presented to one ear may be set to a different level relative to the sound presented to the other ear. In this way, lateralization and volume of the monaural signal are controlled. For example, a telephone signal may be presented to both ears in order to benefit from binaural reception of a telephone call, e.g. by relaying of the caller's voice to the ear without the telephone against it, albeit at the proper phase and level to properly lateralize the sound of the caller's voice.

Hearing devices typically reproduce sound in such a way that the user perceives sound sources to be localized inside the head. The sound is said to be internalized rather than being externalized.

A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing device system with improved localization of sound sources, i.e. there is a need for a new hearing device system capable of imparting perceived spatial information of direction and possibly distance of a respective sound source with relation to a wearer of a hearing device of the hearing device system.

A human with normal hearing will also experience benefits of improved externalization and localization of sound sources when using a hearing device thereby enjoying reproduced sound with externalized sound sources.

Below, a new method is disclosed of positioning sound sources in desired perceived spatial directions or positions in a sound environment of a human.

The new method makes use of the human auditory system's capability of distinguishing sound sources located in different spatial directions or positions in the sound environment, and capability of concentrating on a selected one or more of the spatially separated sound sources.

A new hearing device system using the new method is also disclosed.

According to the new method, signals from different sound sources are presented to the ears of a human in such a way that the human perceives the sound sources to be positioned in different spatial positions or directions in the sound environment of the human. In this way, the human's auditory system's binaural signal processing is utilized to improve the user's capability of separating signals from different sound sources and of focussing his or her listening to a desired one of the sound sources, or simultaneously listen to and understand more than one of the sound sources.

It has also been found that if a speech signal is presented in anti-phase, i.e. phase shifted 180° with relation to each other, in the two ears of the human, a specific direction of arrival of the signal is not perceived; however, many users find speech signals presented in anti-phase easy to separate from other sound sources and understand. This effect may be obtained with a phase shift ranging from 150° to 210°.

Humans detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound as generated by the spatial sound field itself.

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between an audio signal source, such as a microphone, and speakers worn by a listener for emission of sound towards the respective ears of the listener, the listener will achieve the perception that the sounds generated by the speakers originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely improved signal source separation; improved direction of arrival (DOA) estimation; and improved depth/distance perception.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The most important cues in binaural processing are the interaural time differences (ITD) and the interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue since the hearing loss tends to be less severe in the lower frequencies.

A directional transfer function is a Head-Related Transfer Function or an approximation to a Head-Related Transfer Function that adds directional cues to an input signal so that a human listening to a binaural sound signal based on the output signal of a binaural filter with the directional transfer function perceives the sound to be emitted from a sound source residing in a direction defined by the cues.

A new method is provided of imparting perception of a direction or position of a sound source to a human, comprising displaying at least one movable symbol indicating a position of the sound source with relation to the user on a display, moving the at least one movable symbol into a desired position for selection of a perceived direction towards the sound source, selecting a binaural filter with a directional transfer function corresponding to the selected perceived direction towards the sound source, and emitting a binaural sound signal to the ears of the human based on an output signal of the binaural filter with the selected directional transfer function, whereby the human perceives that the sound signal is emitted from the sound source positioned in the selected direction.

In accordance with the new method, a monaural audio signal emitted by a specific source, such as a monaural audio signal from a spouse microphone, a media player, a hearing loop system, a teleconference system, a radio, a TV, a telephone, a device with an alarm, etc., is filtered with a binaural filter in such a way that the human perceives the received monaural audio signal to be emitted by the respective source positioned in the selected direction in space.

Further, a new hearing device system is provided, comprising a hearing device with a first housing accommodating a first speaker and a second housing accommodating a second speaker, and wherein the first and second housings are configured to be worn at a user's respective ears for emission of sound from the speakers towards the respective ears of the user of the hearing device system, a binaural filter having an input signal and connected to the first and second speakers and having a directional transfer function for providing a binaural signal to the first and second speakers, whereby the input signal is perceived by the user to be emitted by a sound source positioned in a direction defined by the directional transfer function, and a control device configured for control of the hearing device system, the control device having a display configured to display at least one movable symbol indicating a position of at least one sound source with relation to the user, a processor coupled for control of the display, and a user interface for user positioning of the at least one movable symbol on the display, and wherein the processor is further configured to control selection of the directional transfer function of the binaural filter based at least in part on a position of the at least one movable symbol on the display.

The first and second speakers may be parts of a binaural hearing aid, i.e. the receivers for the left ear and the right ear of the binaural hearing aid may constitute the first and second speakers, respectively.

The binaural filter may be configured for providing output signals that are equal to the input signal, but phase shifted by different respective amounts and thereby phase shifted with relation to each other.

The binaural filter may alternatively or additionally be configured for providing output signals that are equal to the input signal, but multiplied with different respective gains.

The binaural filter may have a Head-Related Transfer Function.

The hearing device system may have a plurality of binaural filters with different directional transfer functions applied to different input signals arriving from different signal sources, one of the binaural filters being the binaural filter.

A device with the signal source generating the input signal may be a spouse microphone, a media player, a hearing loop system, a teleconference system, a radio, a TV, a telephone, a public announcement system, a device with an alarm, etc.

One or more of the binaural filters may be accommodated in the first and/or second housings.

A device with the signal source may comprise the binaural filter.

The hearing device may comprise a data interface for transmission of data from the control device.

The data interface may be a wired interface, e.g. a USB interface, or a wireless interface, such as a Bluetooth interface, e.g. a Bluetooth Low Energy interface.

The hearing device may comprise an audio interface for reception of an audio signal from the control device or other devices with signal sources capable of transmitting audio signals to the hearing device for provision of the input signals.

The audio interface may be a wired interface or a wireless interface.

The data interface and the audio interface may be combined into a single interface, e.g. a USB interface, a Bluetooth interface, etc.

The hearing device may for example have a Bluetooth Low Energy data interface for exchange of control data between the hearing device and the control device, and a wired audio interface for exchange of audio signals between the hearing device and the control device and other devices with signal sources.

Each of the control device and some or all of the devices with signal sources may have binaural filters with directional transfer functions that can be controlled by the control device in a way similar to the control of the binaural filters of the hearing device. The binaural audio signals output by the binaural filters of the control device and some or all of the devices with signal sources, are transmitted to the hearing device so that binaural filters are not required in the hearing device for these signals whereby power and signal processing resources are saved in the hearing device.

The perceived spatial separation of different signal sources assists the user of the hearing device system in understanding speech in the monaural audio signals emitted by the signal sources, and in focussing the user's listening to a desired one of the audio signals.

For example, a first binaural filter may be configured to output signals intended for the right ear and left ear of the user of the hearing device system that are phase shifted with relation to each other in order to introduce a first interaural time difference whereby the perceived position of the corresponding first sound source is shifted outside the head and laterally with relation to the user of the hearing device system.

In the event that the output signals intended for the right ear and left ear are phase shifted 180° with relation to each other, sense of direction is lost; however, many humans find speech signals phase shifted 180° with relation to each other easy to separate from other signal sources and easy to understand.

Further separation of sound sources may be obtained by provision of further binaural filters so that other monaural signals, such as a second monaural signal received from a second spouse microphone, a media player, a hearing loop system, a teleconference system, a radio, a TV, a telephone, a device with an alarm, etc., is filtered with the second binaural filter in such a way that the user perceives the received second monaural audio signal to be emitted by a sound source positioned in a second position and/or arriving from a second direction in space different from other selected perceived positions and directions.

For example, the second binaural filter may be configured to output signals intended for the right ear and left ear of the user of the hearing device system that are phase shifted with relation to each other in order to introduce a second interaural time difference whereby the corresponding position of the second sound source is shifted laterally, preferably in the opposite direction of the first sound source, with relation to the user of the hearing device system.

Alternatively, or additionally, the first binaural filter may be configured to output signals intended for the right ear and left ear of the user of the hearing device system that are equal to the first audio input signal multiplied with a first right gain and a first left gain, respectively; in order to obtain a first interaural level difference whereby the perceived position of the corresponding first sound source is shifted laterally with relation to the user of the hearing device system.

Alternatively, or additionally, the second binaural filter may be configured to output signals intended for the right ear and left ear of the user of the hearing device system that are equal to the second audio input signal multiplied with a second right gain and a second left gain, respectively, in order to obtain a second interaural level difference whereby the perceived position of the corresponding second sound source is shifted laterally, preferably in the opposite direction of the first sound source, with relation to the user of the hearing device system.

In order for the user of the new hearing device system to perceive the first audio signal source and the second audio signal source to be located in different positions in the surroundings, the pair of first interaural time difference and first interaural level difference must be different from the pair of second interaural time difference and second interaural level difference, e.g. the first and second interaural level differences may be identical provided that the first and second interaural time differences are different and vice versa.

The perceived spatial separation of the perceived signal sources of different audio signals, both of which are perceived to be located outside the head of the user, assists the user in understanding speech in the first and second monaural audio signals, and in focussing the user's listening to a desired one of the first and second monaural audio signals.

The directional transfer function may be a Head-Related Transfer Function; or, an approximation to a Head-Related Transfer Function.

For example, Head-Related Transfer Functions may be determined using a manikin, such as KEMAR. In this way, an approximation to the individual Head-Related Transfer Functions is provided that can be of sufficient accuracy for the user of the hearing device system to maintain sense of direction when wearing the hearing device.

Azimuth is the perceived angle of direction towards the sound source projected onto the horizontal plane with reference to the forward looking direction of the user. The forward looking direction is defined by a virtual line drawn through the centre of the user's head and through a centre of the nose of the user. Thus, a sound source located in the forward looking direction has an azimuth value of 0°, and a sound source located directly in the opposite direction has an azimuth value of 180°. A sound source located in the left side of a vertical plane perpendicular to the forward looking direction of the user has an azimuth value of −90°, while a sound source located in the right side of the vertical plane perpendicular to the forward looking direction of the user has an azimuth value of +90°.

Throughout the present disclosure, one signal is said to represent another signal when the one signal is a function of the other signal, for example the one signal may be formed by analogue-to-digital conversion, or digital-to-analogue conversion of the other signal; or, the one signal may be formed by conversion of an acoustic signal into an electronic signal or vice versa; or the one signal may be formed by analogue or digital filtering or mixing of the other signal; or the one signal may be formed by transformation, such as frequency transformation, etc, of the other signal; etc.

Further, signals that are processed by specific circuitry, e.g. in a signal processor, may be identified by a name that may be used to identify any analogue or digital signal forming part of the signal path of the signal in question from its input of the circuitry in question to its output of the circuitry. For example an output signal of a microphone, i.e. the microphone audio signal, may be used to identify any analogue or digital signal forming part of the signal path from the output of the microphone to its input to the speaker, including any processed microphone audio signals.

The new hearing device system may comprise a binaural hearing aid comprising multi-channel first and/or second hearing aids in which the input signals are divided into a plurality of frequency channels for individual processing of at least some of the input signals in each of the frequency channels.

The plurality of frequency channels may include warped frequency channels, for example all of the frequency channels may be warped frequency channels.

The binaural hearing aid may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The binaural hearing aid may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the new method.

For example, various algorithms may be provided for conventional noise suppression, i.e. attenuation of undesired signals and amplification of desired signals.

Microphone output signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispensers office and programmed into the binaural hearing aid in a non-volatile memory area.

The binaural hearing aid may have a user interface, e.g. buttons, toggle switches, etc, of the hearing aid housings, or a remote control, so that the user of the binaural hearing aid can select one of the available signal processing algorithms to obtain the desired hearing loss compensation in the sound environment in question.

One or both hearing aids may also comprise a telecoil that converts a magnetic field at the telecoil into a corresponding analogue audio signal in which the instantaneous voltage of the audio signal varies continuously with the magnetic field strength at the telecoil. Telecoils may be used to increase the signal to noise ratio of speech from a speaker addressing a number of people in a public place, e.g. in a church, an auditorium, a theatre, a cinema, etc., or through a public address systems, such as in a railway station, an airport, a shopping mall, etc. Speech from the speaker is converted to a magnetic field with an induction loop system (also called "hearing loop"), and the telecoil is used to magnetically pick up the magnetically transmitted speech signal.

The telecoil output audio signal may be input to a binaural filter with directional transfer functions selected by the control device, whereby the user may select a perceived direction of arrival of the telecoil signal so that the telecoil signal as reproduced in the ears of the user is perceived by the user to be emitted by a sound source positioned in a direction defined by the directional transfer function, One or both hearing aids may comprise one or more microphones and a telecoil and a switch, e.g. for selection of an omni-directional microphone signal, or a directional microphone signal, or a telecoil signal, either alone or in any combination, as the audio signal.

Typically, the analogue audio signal is made suitable for digital signal processing by conversion into a corresponding digital audio signal in an analogue-to-digital converter whereby the amplitude of the analogue audio signal is represented by a binary number. In this way, a discrete-time and discrete-amplitude digital audio signal in the form of a sequence of digital values represents the continuous-time and continuous-amplitude analogue audio signal.

The processor of the control device is configured to control the display of the control device to display distinguishable symbols representing various devices that are capable of transmitting an audio signal to the hearing device. Thus each device capable of transmitting an audio signal to the hearing device may be represented by a symbol that is different from the symbols representing other devices. One symbol represents the user.

The user may move the symbols into desired positions on the display using the user interface of the control device. For example, the display may be a touch sensitive display allowing the user to move the symbols by touching and dragging the symbols as is well-known in the art of smartphones.

When the symbols have been moved into their desired positions on the display, the processor controls the corresponding binaural filters connected to respective input signals from sound sources represented by the symbols, for selection of directional transfer function corresponding to the positions on the display of the symbols representing the sound sources with relation to the symbol representing the user, whereby the user perceives the sound sources to be positioned in the directions, or at the positions, indicated by the respective symbols positions on the display.

Preferably, the directions indicated by the respective symbols positions on the display are indicated with reference to the user's forward looking direction.

The hearing device may include an orientation sensor unit for sensing the orientation of the head of the user, when the user wears the hearing device in its intended operational position on the user's head, and the processor may further be configured to adjust selection of the directional transfer function(s) of the binaural filter(s) based at least in part on the sensed orientation of the head of the user.

In this way, the at least one sound source will be perceived to remain fixed with relation to user's environment irrespective of the changes in orientation of the user's head subsequent to the selection of the directional transfer function(s) of the binaural filter(s). Thus, if the user turns his or her head 30° to the left, the processor may be configured to select directional transfer function(s) with perceived direction(s) towards the corresponding at least one sound source turned 30° to the right in such a way that the user perceives the at least one sound source to remain in fixed position(s) in the sound environment, i.e. the rate of change of the perceived direction(s) corresponds to the rate of change of the orientation of the head of the user.

The orientation of the head of the user may be defined as the orientation of a head coordinate system having a vertical axis and two horizontal axes at the current location of the user with relation to a reference coordinate system that is fixed with relation to the surroundings.

A head coordinate system is defined with its centre located at the centre of the user's head, which is defined as the midpoint of a line drawn between the respective centres of the eardrums of the left and right ears of the user.

The x-axis of the head coordinate system is pointing ahead through a centre of the nose of the user, its y-axis is pointing towards the left ear through the centre of the left eardrum, and its z-axis is pointing upwards.

Head yaw is the angle between the current x-axis' projection onto a horizontal plane at the location of the user and a horizontal reference direction, such as the forward looking direction when selection of the directional transfer function is made; or, Magnetic North or True North, head pitch is the angle between the current x-axis and the horizontal plane, and head roll is the angle between the y-axis and the horizontal plane. The x-axis, y-axis, and z-axis of the head coordinate system are denoted the head x-axis, the head y-axis, and the head z-axis, respectively.

The orientation sensor unit may comprise accelerometers for determination of orientation of the hearing device. The orientation sensor unit may determine head yaw based on determinations of individual displacements of two accelerometers positioned with a mutual distance for sensing displacement in the same horizontal direction when the user wears the hearing device. Such a determination is accurate when head pitch and head roll do not change during change of the yaw value.

Alternatively, or additionally, the orientation sensor unit may determine head yaw utilizing a first gyroscope, such as a solid-state or MEMS gyroscope positioned for sensing rotation of the head x-axis projected onto a horizontal plane at the user's location with respect to a horizontal reference direction.

Similarly, the orientation sensor unit may have further accelerometers and/or further gyroscope(s) for determination of head pitch and/or head roll, when the user wears the hearing device in its intended operational position on the user's head.

In order to facilitate determination of head yaw with relation to e.g. True North or Magnetic North of the earth, the orientation sensor unit may further include a compass, such as a magnetometer.

Thus, the orientation sensor unit may have one, two or three axis sensors that provide information of head yaw; or, head yaw and head pitch; or, head yaw, head pitch, and head roll, respectively.

Thus, the hearing device may be equipped with a complete attitude heading reference system (AHRS) for determination of the orientation of the user's head that has either solid-state or MEMS gyroscopes, accelerometers and magnetometers on all three axes. A processor of the AHRS provides digital values of the head yaw, head pitch, and head roll based on the sensor data.

Thus, the processor may be configured to select directional transfer function(s) with a changed yaw of the perceived direction(s) that compensates the changed yaw of the orientation of the head of the user so that the user perceives the at least one sound source to remain in fixed position(s) in the sound environment.

Likewise, the processor may be configured to select directional transfer function(s) with a changed pitch of the perceived direction(s) that compensates the changed pitch of the orientation of the head of the user so that the user perceives the at least one sound source to remain in fixed position(s) in the sound environment.

Likewise, the processor may be configured to select directional transfer function(s) with a changed roll of the perceived direction(s) that compensates the changed roll of the orientation of the head of the user so that the user perceives the at least one sound source to remain in fixed position(s) in the sound environment.

The selection of the directional transfer function(s) of the binaural filter(s) may be performed when the user inputs a specific user command with the user interface, e.g. by touching a selection symbol on the display; or by not moving any movable symbol for a certain time period, e.g. 5 seconds; or in another suitable way.

A symbol may be deleted from the display by dragging it to the edge of the display as is well-known in the art of smartphones. A new symbol may be added to the display by dragging a palette of selectable symbols from the edge of the display and drag a selected symbol from the palette into the display as is also well-known in the art of smartphones.

Throughout the present disclosure, the "audio signal" may be used to identify any analogue or digital signal forming part of the signal path from the output of the microphone(s) or telecoil or other input signals, to an input of the processor.

Throughout the present disclosure, the "hearing loss compensated audio signal" may be used to identify any analogue or digital signal forming part of the signal path from the output of the signal processor to an input of the output transducer. The binaural hearing aid may be capable of automatically classifying the users sound environment into one of a number of sound environment categories, such as speech, babble speech, restaurant clatter, music, traffic noise, etc, and may automatically select the appropriate signal processing algorithm accordingly as known in the art.

Signal processing in the new hearing device system may be performed by dedicated hardware or may be performed in one or more signal processors, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing device system includes: a hearing device with a first housing accommodating a first speaker and a second housing accommodating a second speaker, wherein the first and second housings are configured to be worn at a user's respective ears for emission of sound from the speakers towards the respective ears of the user; a binaural filter having an input signal and connected to the first and second speakers, and having a directional transfer function for providing a binaural signal to the first and second speakers, whereby the input signal is perceived by the user to be emitted by a sound source positioned in a direction defined by the directional transfer function; and a control device configured for control of the hearing device system, the control device having a display configured to display at least one movable symbol indicating a position of at least one sound source with relation to the user, a processor, and a user interface for user positioning of the at least one symbol on the display; wherein the processor is configured to determine the directional transfer function of the binaural filter based at least in part on a position of the at least one movable symbol on the display.

Optionally, the binaural filter is configured for providing output signals equal to the input signal phase shifted by different respective amounts.

Optionally, the binaural filter is configured for providing output signals equal to the input signal multiplied with different respective gains.

Optionally, the directional transfer function is a Head-Related Transfer Function.

Optionally, the hearing device system further includes a plurality of binaural filters with different respective directional transfer functions, one of the binaural filters being the binaural filter.

Optionally, the input signal is generated by a device selected from the group consisting of: a spouse microphone, a media player, a hearing loop system, a teleconference system, a radio, a TV, a telephone, a public announcement system, and a device with an alarm.

Optionally, one of the first and second hearing aid housings accommodates the binaural filter.

Optionally, the binaural filter is configured to generate the input signal.

Optionally, the first and second speakers are parts of a binaural hearing aid.

Optionally, the binaural hearing aid comprises a telecoil configured to provide a telecoil output signal as the input signal.

A method of imparting perception of a position of a sound source to a user of a hearing device, includes: displaying at least one movable symbol indicating a position of the sound source with relation to the user on a display; moving the at least one movable symbol into a desired position for selection of a perceived direction towards the sound source; selecting a binaural filter with a directional transfer function corresponding to the selected perceived direction towards the sound source; and emitting a binaural sound signal to ears of the user based on the selected binaural filter with the directional transfer function, whereby the user perceives that the sound signal is emitted from the sound source positioned in the selected perceived direction.

Other and further aspects and features will be evident from reading the following detailed description.

BRIEF DESCRIPTION OF THE FIGURES

In the following, embodiments are explained in more detail with reference to the drawing, wherein FIG. 1 schematically illustrates an exemplary user situation, FIG. 2 schematically illustrates an exemplary new hearing device system, FIG. 3 schematically illustrates an exemplary new hearing device system, FIG. 4 schematically illustrates an exemplary new hearing device system, FIG. 5 schematically illustrates an exemplary new hearing device system, and FIG. 6 schematically illustrates an exemplary new hearing device system.

DETAILED DESCRIPTION

Figure 1:
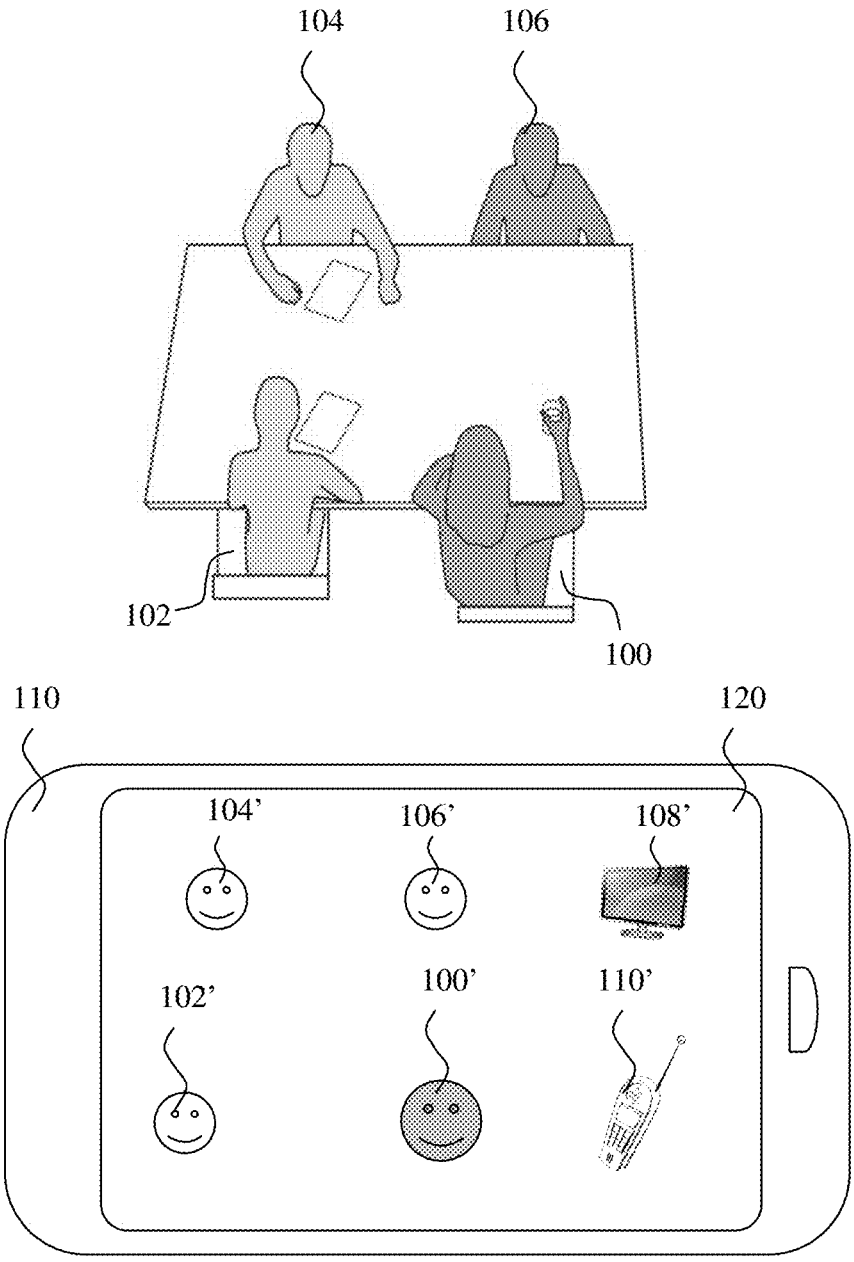

Various embodiments are described hereinafter with reference to the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and hearing device system will now be described more fully hereinafter with reference to the accompanying drawings, in which various examples of the new hearing device system are shown. The new method and hearing device system may, however, be embodied in different forms and should not be construed as limited to the examples set forth herein.

Like reference numerals refer to like elements throughout. Like elements will, thus, not be described in detail with respect to the description of each figure.

The upper part of FIG. 1 schematically illustrates a meeting in which one of the participants 100 uses a new hearing device system (not visible) comprising a binaural hearing aid (not visible) and his or her smartphone 110 controlling the binaural hearing aid and illustrated in the lower part of FIG. 1. The other meeting participants 102, 104, 106 wear spouse microphones (not visible) that transmit speech from the respective meeting participants to the binaural hearing aid of participant 100. Further, a participant in a remote location also participates in the meeting using a teleconference system (not shown).

The smartphone 110 of participant 100, has a display 120 controlled by a processor (not shown) for displaying movable symbols 100', 102', 104', 106', 108', 110' of the at least one movable symbol. The positions on the display 120 of each of the symbols 100', 102', 104', 106', 108', 110' indicate the desired perceived positions of the corresponding participants 102, 104, 106, and devices, i.e. the teleconference system 108 (not shown) and the smartphone 110 of with relation to the user, i.e. participant 100.

The user 100 may move each of the symbols 100', 102', 104', 106', 108', 110' around the display 120 in a way well-known in the art of smartphones, by touching the symbol in question with a fingertip while moving the fingertip into the desired position on the display 120, and the moving the finger tip away from the display 120.

A symbol may be deleted from the display by dragging it to the edge of the display as is well-known in the art of smartphones. A new symbol may be added to the display by dragging a palette of selectable symbols from the edge of the display 120 and drag a selected symbol from the palette into the display 120 as is also well-known in the art of smartphones.

In FIG. 1, the user 100 has positioned symbols 102', 104', 106' of the other participants 102, 104, 106 in positions relative to the symbol 100' of the user 100 that correspond to the relative positions of the participants around the table at the meeting so that the user 100 will perceive speech from the participants 102, 104, 106 as arriving from the true directions of the respective participants 102, 104, 106.

Further, the user 100 has positioned a symbol 108' of the teleconference system 108 (not shown) to the right of the symbol 106' of participant 106 so that the user 100 will perceive speech from the remote participant (not shown) using the teleconference system as arriving from a person seated to the right (seen from the user) of participant 106.

Finally, the user 100 has positioned a symbol 110' of his or her smartphone 110 to the right so that the user may hear messages from his or her smartphone 110 as arriving from someone positioned to the right of the user 100 at the meeting table.

The smartphone 110 is connected to the hearing aids (not visible) of the binaural hearing aid of the user 100 with a Bluetooth Low Energy wireless data interface for transmission of control signals to the hearing aids for selection of binaural filters in the hearing aids having directional transfer functions corresponding to the positions of the movable symbols 102', 104', 106', 108', 110' with relation to the symbol 100' of the user on the display so that each of the sound signals from the participants 102, 104, 106 and devices 108, 110 associated with the symbols 102', 104', 106', 108', 110' is filtered by a binaural filter having a directional transfer function corresponding to the relative position on the display 120 of the corresponding respective symbol 102', 104', 106', 108', 110' in relation to the symbol 100' of the user. Thus, the display 120 shows a map of participants and devices indicating the direction of arrival of sound from the shown participants and devices, perceived by the user 100.

Figure 2:
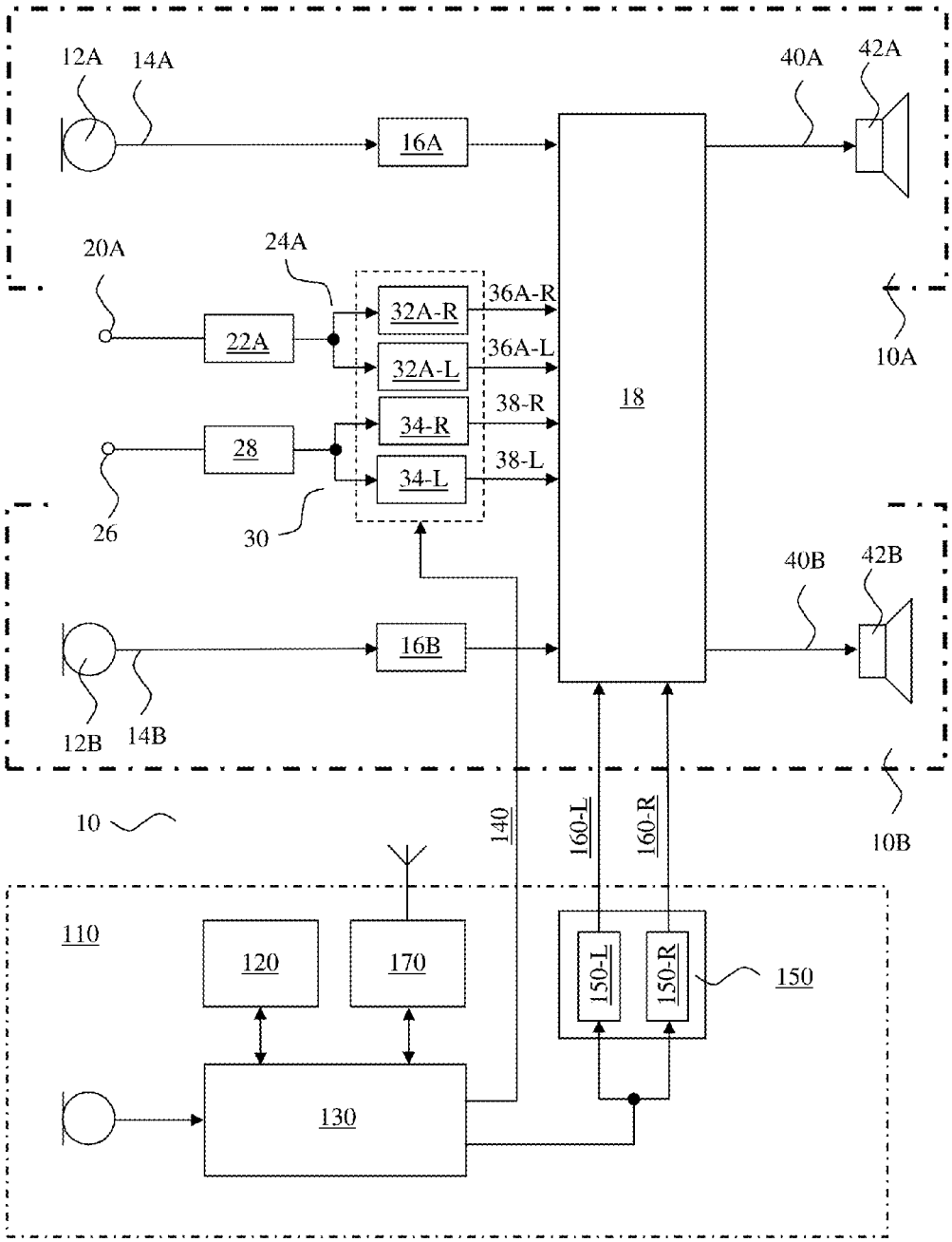

FIG. 2 schematically illustrates an example of the new hearing device system 10 with a binaural hearing aid with a first hearing aid 10A for the right ear and a second hearing aid 10B for the left ear, and a control device, namely a smartphone 110, interconnected with the binaural hearing aid 10A, 10B for control of the binaural hearing aid 10A, 10B through a data interface and for transmission of audio signals through an audio interface. The illustrated hearing device system 10 may use speech syntheses to issue messages and instructions to the user and speech recognition may be used to receive spoken commands from the user.

The first hearing aid 10A comprises a first microphone 12A for provision of first microphone audio signal 14A in response to sound received at the first microphone 12A. The microphone audio signal 14A may be pre-filtered in a first pre-filter 16A well-known in the art, and input to a signal processor 18.

The first microphone 12A may include two or more microphones with signal processing circuitry for combining the microphone signals into the microphone audio signal 14A. For example, the first hearing aid 10A may have two microphones and a beamformer for combining the microphone signals into a microphone audio signal 14A with a desired directivity pattern as is well-known in the art of hearing aids.

The first hearing aid 10A also comprises a first input 20A for provision of a first audio input signal 24A representing sound output by a first sound source (not shown) that is not a part of the first hearing aid 10A, and received at the first input 20A.

The first sound source may be a spouse microphone (not shown) carried by a person 102, 104, 106, the hearing aid user desires to listen to. The output signal of the spouse microphone is encoded for transmission to the first hearing aid 10A using wireless or wired data transmission. The transmitted data representing the spouse microphone audio signal are received by a receiver and decoder 22A for decoding into the first audio input signal 24A.

The second hearing aid 10B comprises a second microphone 12B for provision of second microphone audio signal 14B in response to sound received at the second microphone 12B. The microphone audio signal 14B may be pre-filtered in a second pre-filter 16B well-known in the art, and input to signal processor 18.

The second microphone 12B may include two or more microphones with signal processing circuitry for combining the microphone signals into the microphone audio signal 14B. For example, the second hearing aid 10B may have two microphones and a beamformer for combining the microphone signals into a microphone audio signal 14B with a desired directivity pattern as is well-known in the art of hearing aids.

The binaural hearing aid 10A, 10B also comprises a second input 26 for provision of a second audio input signal 30 representing sound output by a second sound source (not shown) and received at the second input 26.

The second sound source may be a second spouse microphone (not shown) carried by a second person 102, 104, 106, the hearing aid user desires to listen to. The output signal of the second spouse microphone is encoded for transmission to the binaural hearing aid 10A, 10B using wireless or wired data transmission. The transmitted data representing the spouse microphone audio signal are received by a receiver and decoder 28 for decoding into the second audio input signal 30.

The second input 26 and receiver and decoder 28 may be accommodated in the first hearing aid 10A or in the second hearing aid 10B.

The binaural hearing aid 10A, 10B also comprises further inputs (not shown) similar to the second input 26 for provision of further audio input signals representing sound output by further sound sources (not shown) that do not form part of the first and second hearing aids 10A, 10B.

The further inputs and receivers and decoders may be accommodated in the first hearing aid 10A or in the second hearing aid 10B.

The received signals 20A, 26 are compensated for hearing loss, as is well-known in the art of hearing aids, and perceived spatial separation of the signal sources are added to the received signals, i.e. the audio input signals 24A, 30 are filtered with binaural filters 32A-R, 32A-L; 34-R, 34-L, in such a way that the user of the hearing device system 10 perceives the corresponding signal sources to be externalized, i.e. moved away from the centre of the head of the user, and positioned in different positions in his or her surroundings.

The resulting perceived spatial separation of the sound sources improves the capability of the user's auditory system's binaural signal processing of separating sound signals and focussing his or her attention to a desired one of the sound signals, or even to simultaneously listen to and understand more than one sound signal. As used in this specification, the term "signal" (as in, e.g., "binaural signal" or "binaural sound signal", etc.) may refer to one or more signals (e.g., signals for different respective ears).

It is also possible to present one sound signal in anti-phase, since it has been found that if a speech signal is presented in anti-phase, i.e. phase shifted 180° with relation to each other, in the two ears of the user, a specific direction of arrival of the speech signal is not perceived; however, many users find the speech signal presented in anti-phase easy to separate from other signals and understand.

In the illustrated new binaural hearing aid 10A, 10B a set of two filters 32A-R, 32A-L, 34-R, 34-L is provided with inputs connected to the respective outputs 24A, 30 of each of the respective receivers and decoders 22A, 28 and with outputs 36A-R, 36A-L, 38-R, 38-L, one of which 36A-R, 38-R provides an output signal to the right ear and the other 36A-L, 38-L provides an output signal to the left ear. The sets of two filters 32A-R, 32A-L, 34-R, 34-L have directional transfer functions, e.g. of respective HRTFs 32A, 34 imparting selected perceived directions of arrival to the first and second sound sources. Only, two audio inputs 20A, 26 with associated circuitry are shown in FIG. 2; however, further similar audio inputs (not shown) with similar associated circuitry (not shown) are included in the hearing aids 10A, 10B.

The output of the filters 32A-R, 32A-L, 34-R, 34-L, are processed in signal processor 18 for hearing loss compensation and the processor output signal 40A intended to be transmitted towards the right ear is connected to a first receiver 42A of the first hearing aid 10A for conversion into an acoustic signal for transmission towards an eardrum of the right ear of a user of the binaural hearing aid 10A, 10B, and the processor output signal 40B intended to be transmitted towards the left ear is connected to a second receiver 42B of the second hearing aid 10B for conversion into an acoustic signal for transmission towards an eardrum of the left ear of the user of the binaural hearing aid 10A, 10B.

The directional transfer functions of the binaural filters may be individually determined for the user of the hearing device system 10, whereby the user's perceived externalization of and sense of direction towards the various sound sources 102, 104, 106, 108, 110 will be distinct since the HRTFs will contain all information relating to the sound transmission to the ears of the user, including diffraction around the head, reflections from shoulders, reflections in the ear canal, etc., which cause variations of HRTFs of different users.

Good sense of directions may also be obtained by approximations to individually determined HRTFs, such as HRTFs determined on a manikin, such as a KEMAR head. Likewise, approximations may be constituted by HRTFs determined as averages of individual HRTFs of humans in a selected group of humans with certain physical similarities leading to corresponding similarities of the individual HRTFs, e.g. humans of the same age or in the same age range, humans of the same race, humans with similar sizes of pinnas, etc.

Good sense of directions may also be obtained by approximations to individually determined HRTFs constituted by binaural filters with directional transfer functions that add only one or more directional cues to the input signal, such as Interaural Time Difference and/or Interaural Level Difference.

It should be noted that the binaural hearing aid 10A, 10B shown in FIG. 2, may be substituted with another type of hearing device, including the binaural hearing aid shown in FIGS. 3-6.

It should also be noted that the binaural hearing aid 10A, 10B shown in FIG. 2, may be substituted with another type of hearing device, including an Ear-Hook, In-Ear, On-Ear, Over-the-Ear, Behind-the-Neck, Helmet, Headguard, etc, headset, headphone, earphone, ear defenders, earmuffs, etc.

The illustrated binaural hearing aid 10A, 10B may comprise any type of hearing aids, such as a BTE, a RIE, an ITE, an ITC, a CIC, etc, hearing aids. The illustrated binaural hearing aid may also be substituted by a single monaural hearing aid worn at one of the ears of the user, in which case sound at the other ear will be natural sound inherently containing the characteristics of the user's individual HRTFs.

The illustrated binaural hearing aid 10A, 10B has a user interface (not shown), e.g. with push buttons and dials as is well-known from conventional hearing aids, for user control and adjustment of the binaural hearing aid 10A, 10B and possibly the smartphone 110 interconnected with the binaural hearing aid 10A, 10B, e.g. for selection of media to be played back.

In addition, the microphones of binaural hearing aid 10A, 10B may be used for reception of spoken commands by the user transmitted (not shown) to the smartphone 110 for speech recognition in a processor 130 of the smartphone 110, for decoding of the spoken commands and for controlling the hearing device system 10 to perform actions defined by respective spoken commands.

The smartphone 110 has a touch screen 120 controlled by the processor 130 to display movable symbols as further explained above with reference to FIG. 1.

In response to the positioning of the movable symbols on the touch screen, the processor 130 transmits control signals 140 through a data interface to the binaural hearing aid 10 for selection of binaural filters 32A-R, 32A-L, 34-R, 34-L, etc, with directional characteristics corresponding to the relative positioning of the symbols on the touch screen 120.

The data interface may be a wired interface, e.g. a USB interface, or a wireless interface, such as a Bluetooth interface, e.g. a Bluetooth Low Energy interface.

All or some of the binaural filters 32A-R, 32A-L, 34-R, 34-L, etc, may reside in devices generating audio signals for transmission to the binaural hearing aid 10 so that the generated audio signal is transmitted as a binaural audio signal to the binaural hearing aid 10 through its audio interface, and the corresponding control signals from the processor are transmitted to the device with the binaural filter in question.

Likewise, the processor 130 selects a binaural filter 150, i.e. a pair of filters 150-L, 150-R, accommodated in the smartphone 110 with a directional characteristic, preferably a Head-Related Transfer Function, corresponding to the relative positioning of the symbol of the smart phone 110' with relation to the user 100', see FIG. 1, and transmits a binaural output signal 160-L for the left ear and 160-R for the right ear, of the binaural filter 150 through the audio interface to a processor 18 of the binaural hearing aid 10 for conversion into an acoustic binaural signal and emission towards the respective ears of the user.

The smartphone 110 may output audio signals representing any type of sound, such as speech, e.g. from an audio book, radio, etc, music, tone sequences, etc.

The user may for example decide to listen to a radio station while walking, and the smartphone 110 outputs binaural audio signals 160-L, 160-R reproducing the signals originating from the desired radio station filtered by binaural filter 150, i.e. filter pair 150-L, 150-R, with the HRTF specified by the user using the touch screen 120, so that the user perceives to hear the desired radio station from the direction corresponding to the selected HRTF.

The audio interface may be a wired interface or a wireless interface.

The data interface and the audio interface may be combined into a single interface, e.g. a USB interface, a Bluetooth interface, etc.

The binaural hearing aid may for example have a Bluetooth Low Energy data interface for exchange of control data between the hearing device and the device, and a wired audio interface for exchange of audio signals between the hearing device and the device.

The illustrated smartphone 110 may have a GPS-receiver-, mobile telephone- and WiFi-interface 170.

Figure 3:
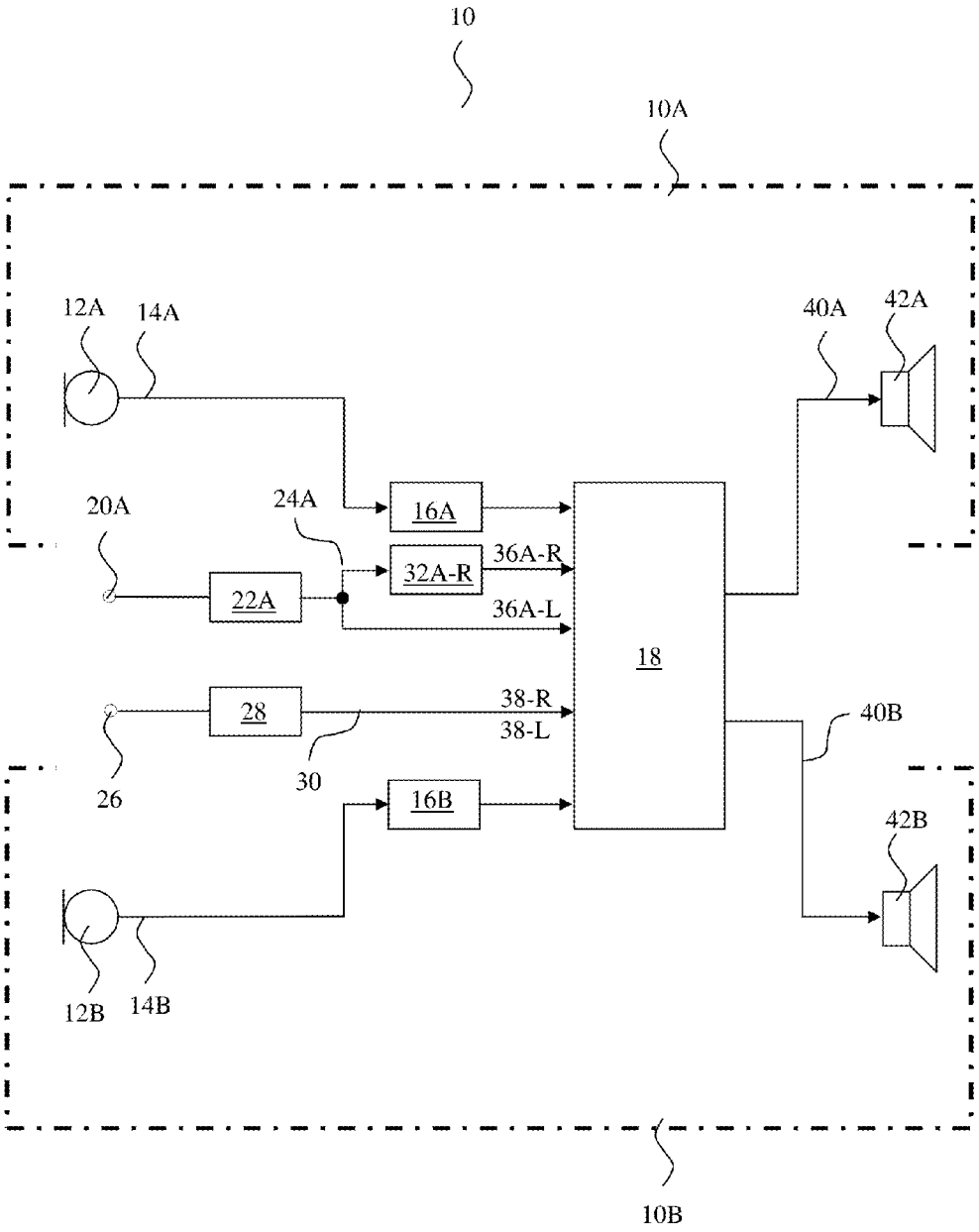

FIG. 3 shows another example of the new hearing device system 10 similar to the hearing device system shown in FIG. 2 except for the fact that sufficient perceived spatial separation between the first and second sound sources is obtained by introducing a delay equal to the ITD of a desired azimuth direction of arrival in the signal path from the first receiver and decoder 22A to one of the ears of the user. In the illustrated example, the filter 32A-R introduces a time delay between its input signal 24A and output signal 36A-R intended for the right ear of the user, while the filter 32A-L shown in FIG. 2 is constituted by a direct connection in FIG. 3 between input 24A and output 36A-L.

Further audio inputs (not shown) similar to audio input 20A with similar associated circuitry (not shown) introducing different perceived azimuth directions of arrival to the received audio signals are provided in one or both of the hearing aids 10A, 10B.

In this way, the perceived azimuth of the direction of arrival of the first sound source is shifted, e.g. to −45°, while the signal from the second sound source is presented monaurally to the ears of the user, i.e. the output 30 of the receiver and decoder 28 is input as a monaural signal to the signal processor 18 and output to both ears of the user. Thus, perceived spatial separation of the first and second sound sources is obtained, since the first sound source is perceived to be position in a direction determined by the delay 32A-R, e.g. 45° azimuth, while the second sound source is perceived to be positioned at the centre inside the head of the user.

Figure 4:
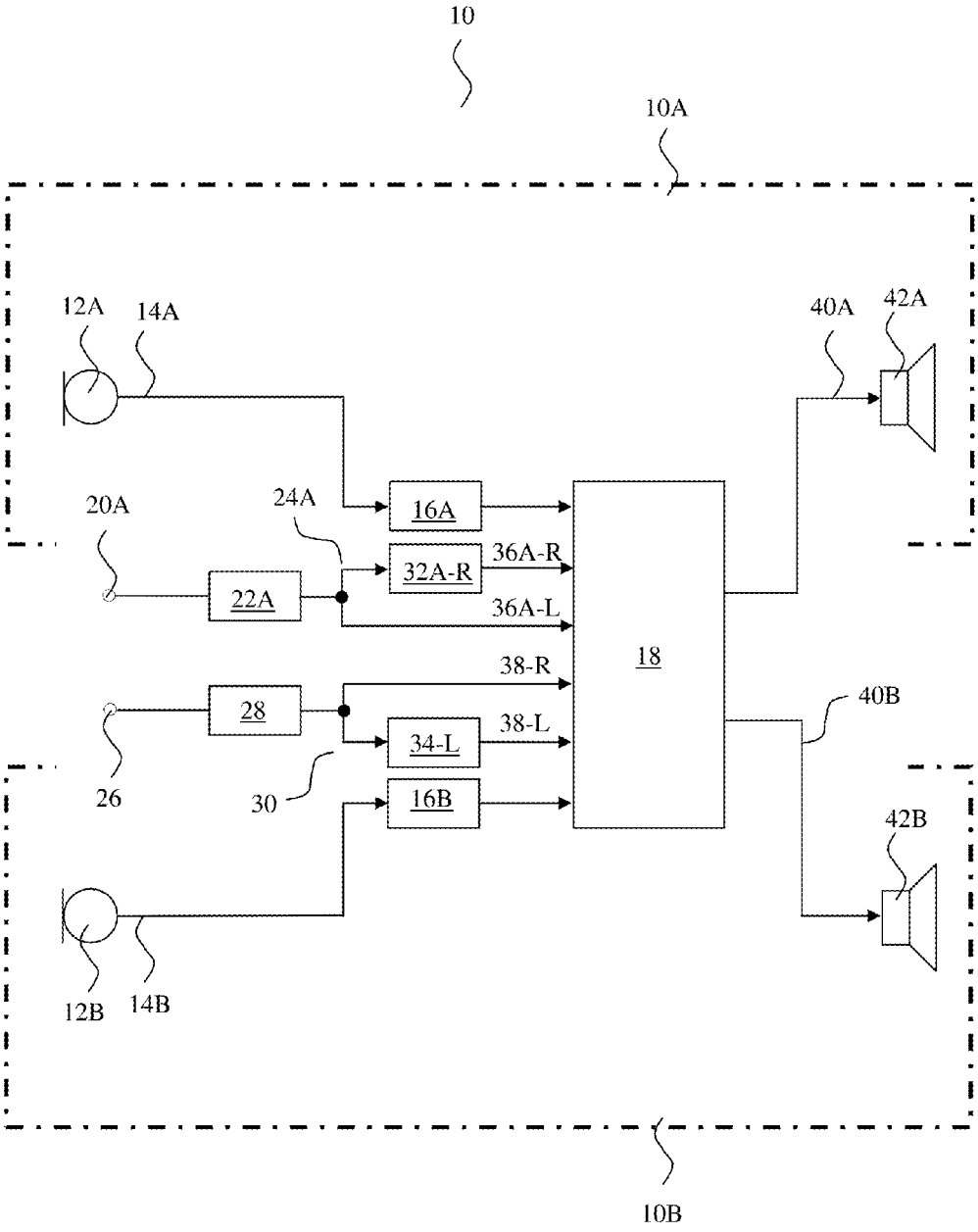

FIG. 4 shows another example of the new hearing device system 10 similar to the example shown in FIG. 3 except for the fact that improved perceived spatial separation between the first and second sound sources is obtained by introducing an additional delay equal to the ITD of a desired second azimuth direction of arrival in the signal path from the second receiver and decoder 28 to one of the ears of the user. For example, the filter 34-L may introduce a time delay between its input signal 30 and output signal 38-L intended for the left ear of the user, while the filter 34-R shown in FIG. 1 is constituted by a short-circuit between input 30 and output 38-R.

In this way, the perceived azimuth of the direction of arrival of the second sound source is shifted, e.g. to +45° while the perceived azimuth of the direction of arrival of the first sound source remains shifted, e.g. to −45°. Thus, improved perceived spatial separation of the first and second sound sources is obtained, since the first sound source is perceived to be position in a direction determined by the delay 32A-R, e.g. at −45° azimuth, while the second sound source is perceived to be positioned in a direction determined by the delay 34-L, e.g. at +45° azimuth.

In FIGS. 2, 3, and 4, the dashed lines indicate the housings of the first and second hearing aids 10A, 10B accommodating the components of the binaural hearing aid 10A, 10B. Each of the housings accommodates the one or more microphones 12A, 12B for reception of sound at the respective ear of the user for which the respective hearing aid 10A, 10B is intended for performing hearing loss compensation, and the respective receiver 42A, 42B for conversion of the respective output signal 40A, 40B of the signal processor 18 into acoustic signals for transmission towards eardrum of the respective one of the right and left ears of the user.

The remaining circuitry may be distributed in arbitrary ways between the two hearing aid housings in accordance with design choices made by the designer of the hearing device system 10. Each of the signals in the binaural hearing aid shown in FIGS. 2, 3 and 4 may be transmitted by wired or wireless transmission between the hearing aids 10A, 10B in a way well-known in the art of signal transmission.

Figure 5:
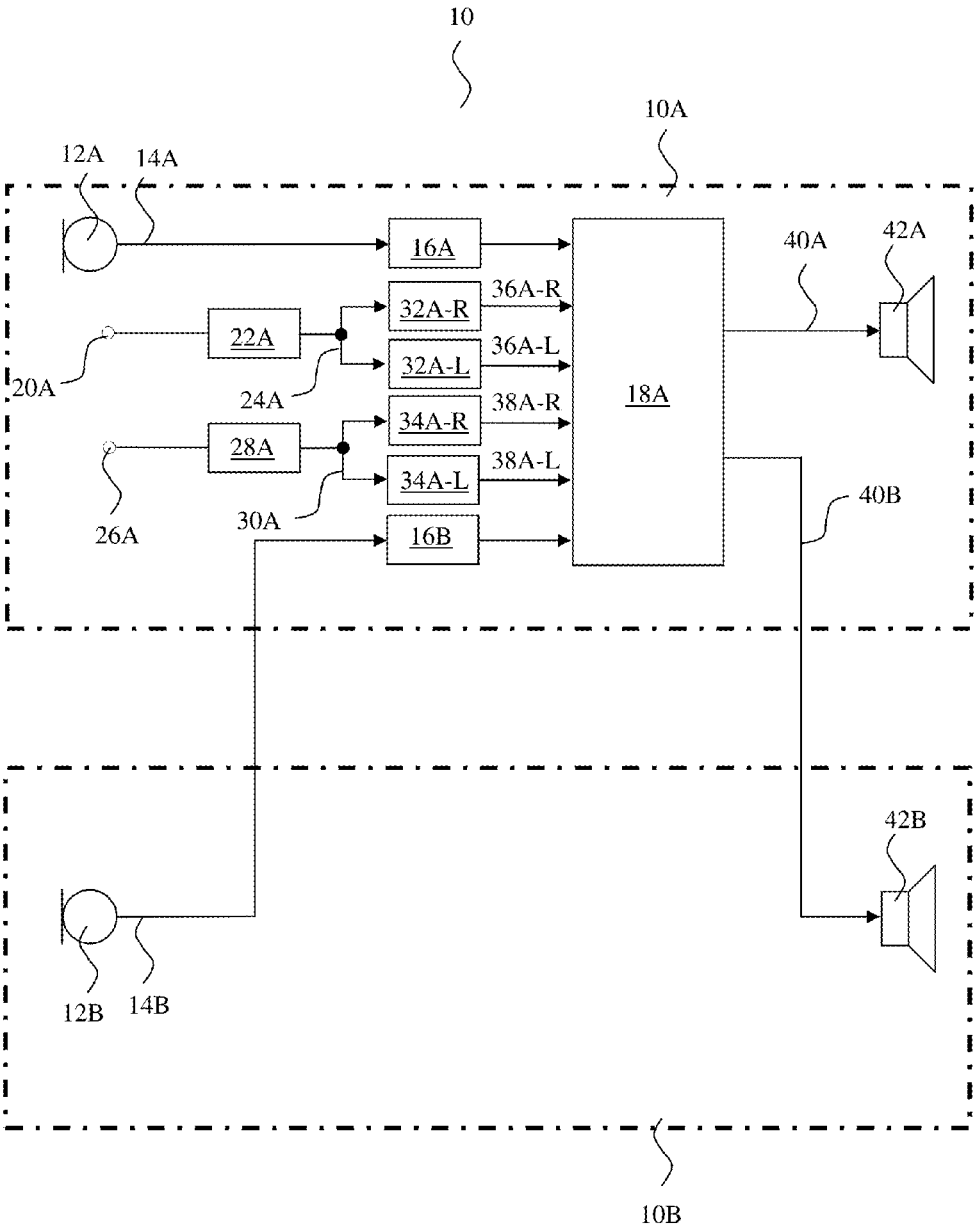

FIG. 5 shows another example of the new hearing device system 10 shown in FIG. 2, wherein the second hearing aid 10B does not have a signal processor 18 and does not have inputs for provision of first and second audio input signals representing sound from respective first and second sound sources. The second hearing aid 10B only has the one or more second microphone 12B and the second receiver 42B and the required encoder and transmitter (not shown) for transmission of the microphone audio signal 14B for signal processing in the first hearing aid 10A, and receiver and decoder (not shown) for reception of the output signal 40B of the signal processor 18A. The remaining circuitry shown in FIG. 1 is accommodated in the housing of the first hearing aid 10A.

Figure 6:
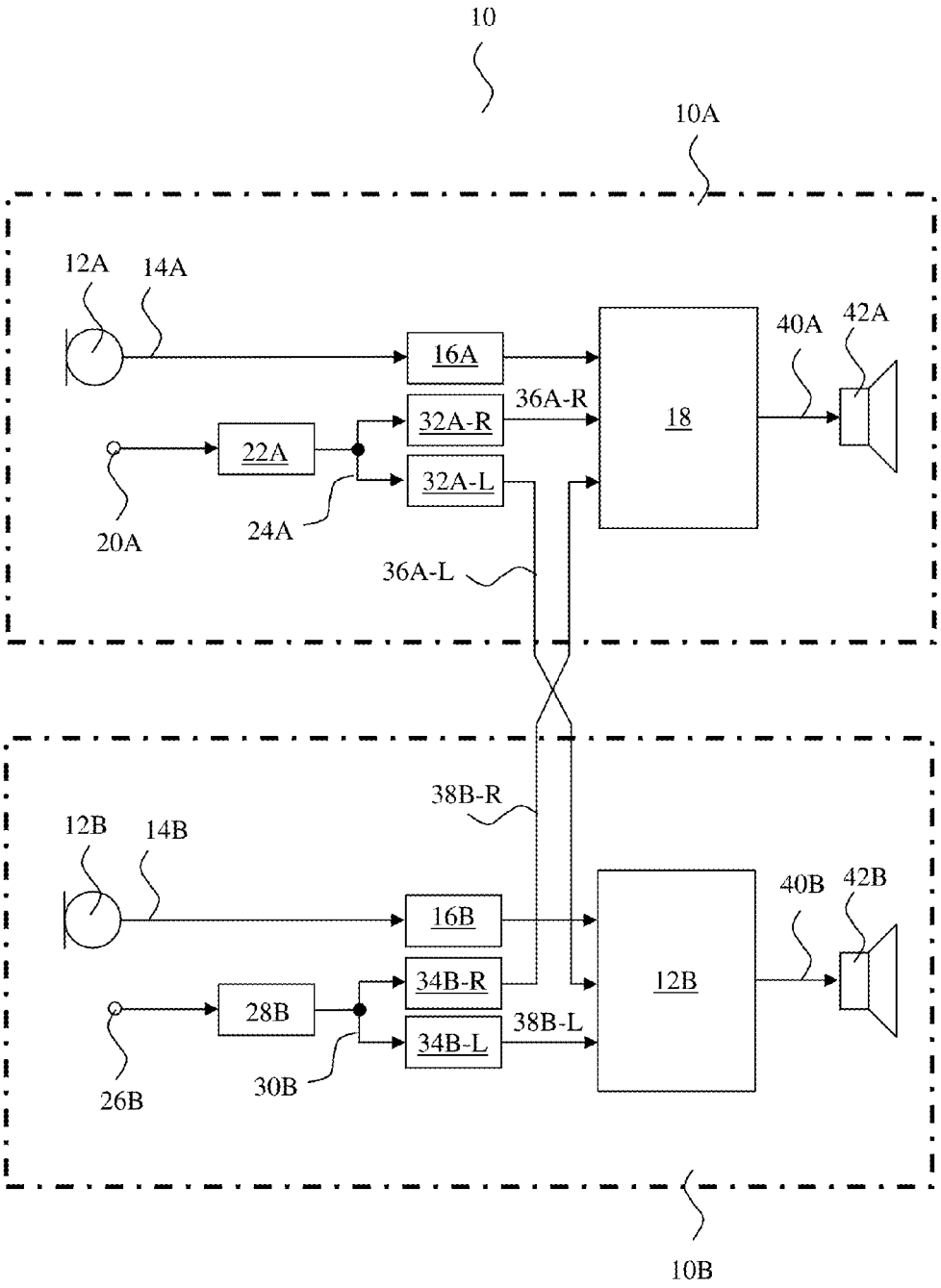

FIG. 6 shows another example of the new hearing device system 10 shown in FIG. 2, wherein the first and second hearing aids 10A, 10B both comprise a microphone, and a receiver, and a hearing aid processor.

Thus, the illustrated new binaural hearing aid 10A, 10B comprises,

A first hearing aid 10A comprising a first input 20A for provision of a first audio input signal 24A representing sound output by a first sound source and received at the first input 20A, a first binaural filter 32A-R, 32A-L for filtering the first audio input signal 24A and configured to output a first right ear signal 36A-R for the right ear and a first left ear signal 36A-L for the left ear that are that are equal to the first audio input signal multiplied with a first right gain and a different first left gain, respectively, and/or phase shifted differently with a resulting first phase shift with relation to each other, a first ear receiver 42A for conversion of a first ear receiver input signal 40A into an acoustic signal for transmission towards an eardrum of the first ear of a user of the binaural hearing aid 10A, 10B, and a second input 26B for provision of a second audio input signal 30B representing sound output by a second sound source and received at the second input 26B, a second binaural filter 34B-R, 34B-L for filtering the second audio input signal 30B and configured to output a second right ear signal 38B-R for the right ear and a second left ear signal 38B-L for the left ear that are equal to the second audio input signal multiplied with a second right gain and a different second left gain, respectively, and/or that are phase shifted differently with a resulting second phase shift different from the first phase shift with relation to each other, and wherein the first and second right ear signals 36A-R, 38B-R are provided to the first ear receiver input 40A, and the first and second left ear signals 36A-L, 38B-L are provided to the second ear receiver input 40B.

Although particular embodiments have been shown and described, it will be understood that they are not intended to limit the claimed inventions, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing device system comprising:

a hearing device with a first housing accommodating a first speaker and a second housing accommodating a second speaker, wherein the first and second housings are configured to be worn at a user's respective ears for emission of sound from the speakers towards the respective ears of the user;

a first binaural filter connected to the first and second speakers, and having a first directional transfer function for providing a first binaural signal to the first and second speakers, whereby a first input signal is perceived by the user to be emitted by a first sound source positioned in a first direction defined by the first directional transfer function;

a first decoder coupled to an input of the first binaural filter;

a second binaural filter connected to the first and second speakers, and having a second directional transfer function for providing a second binaural signal to the first and second speakers, whereby a second input signal is perceived by the user to be emitted by a second sound source positioned in a second direction defined by the second direction transfer function; and a control device configured for control of the hearing device system, the control device having a display configured to display movable symbols indicating respective positions of the first and second sound sources with relation to the user, a processor coupled for control of the display, and a user interface for user positioning of the symbols on the display;

wherein the processor is configured to determine the directional transfer functions of the first and second binaural filters based at least in part on positions of the respective movable symbols on the display;

wherein the hearing device system is a hearing aid system, the hearing device being a first hearing aid, and wherein the second housing is a part of a second hearing aid; and wherein the first and second input signals are generated by spouse microphones.

2. The hearing device system according to claim 1, wherein the first binaural filter is configured for providing first output signals equal to the first input signal phase shifted by different respective amounts.

3. The hearing device system according to claim 1, wherein the first binaural filter is configured for providing first output signals equal to the first input signal multiplied with different respective gains.

4. The hearing device system according to claim 1, wherein the first directional transfer function is a Head-Related Transfer Function.

5. The hearing device system according to claim 1, comprising a plurality of binaural filters with different respective directional transfer functions, one of the binaural filters being the first binaural filter.

6. The hearing device system according to claim 1, wherein the input signal is generated by a device selected from the group consisting of: a spouse microphone, a media player, a hearing loop system, a teleconference system, a radio, a TV, a telephone, a public announcement system, and a device with an alarm.

7. The hearing device system according to claim 1, wherein one of the first and second hearing aid housings accommodates the first binaural filter.

8. The hearing device system according to claim 1, wherein the device generating the first input signal, comprises the first binaural filter.

9. The hearing device system according to claim 1, further comprising an orientation sensor unit for sensing an orientation of a head of the user, wherein the processor is configured to determine another directional transfer function of the binaural filter based at least in part on the sensed orientation of the head of the user in such a way that the user perceives the one of the sound sources as remaining in fixed position(s).

10. The hearing device system according to claim 1, wherein the first and second speakers are parts of a binaural hearing aid.

11. The hearing device system according to claim 10, wherein the binaural hearing aid comprises a telecoil configured to provide a telecoil output signal as the input signal.

12. A method of imparting perception of positions of spouse microphones to a user of a hearing device, comprising:

displaying movable symbols indicating respective positions of the spouse microphones with relation to the user on a display;

moving the symbols into desired respective positions for selection of perceived directions towards the spouse microphones;

selecting binaural filters with directional transfer functions corresponding to the respective selected perceived directions towards the spouse microphones;

providing a first input from a first decoder to at least one of the binaural filters; and emitting binaural sound signals to ears of the user based on the selected binaural filters with the respective directional transfer functions, whereby the user perceives that the sound signals are emitted from the spouse microphones positioned in the respective selected perceived directions.

13. The method according to claim 12, wherein the desired positions are equal to the respective positions of the spouse microphones with relation to the user of the hearing aid system.

14. The hearing device according to claim 1, wherein the hearing aid system is configured to compensate for a hearing loss of the user.

15. The hearing device according to claim 1, further comprising a second decoder coupled to an input of the second binaural filter.

16. The method according to claim 12, further comprising providing a second input from a second decoder to another one of the binaural filters.

17. The method according to claim 12, wherein the act of emitting binaural sound signals is performed by a hearing aid system that is configured to compensate for a hearing loss of the user.

* * * * *